US007017789B2

(12) United States Patent
Mochizuki et al.

(10) Patent No.: US 7,017,789 B2
(45) Date of Patent: Mar. 28, 2006

(54) STAPLER CARTRIDGE AND STAPLER APPARATUS COMPRISING THE SAME

(75) Inventors: Naoto Mochizuki, Yamanashi Prefecture (JP); Yosuke Sajiki, Yamanashi Prefecture (JP)

(73) Assignees: ACCO Brands USA LLC, Lincolnshire, IL (US); NISCA Corporation, Yamanashi-Ken (JP)

( * ) Notice: Subject to any disclaimer, the term of this patent is extended or adjusted under 35 U.S.C. 154(b) by 79 days.

(21) Appl. No.: 10/434,000

(22) PCT Filed: Dec. 21, 2001

(86) PCT No.: PCT/IB01/02623

§ 371 (c)(1),
(2), (4) Date: Jun. 9, 2003

(87) PCT Pub. No.: WO02/098613

PCT Pub. Date: Dec. 12, 2002

(65) Prior Publication Data

US 2005/0098603 A1 May 12, 2005

(30) Foreign Application Priority Data

Dec. 28, 2000 (JP) ..... 2000-402783

(51) Int. Cl.
*B65B 5/16* (2006.01)
*B27F 7/21* (2006.01)

(52) U.S. Cl. ..... 227/119; 227/131; 227/136

(58) Field of Classification Search ..... 227/131, 227/107, 120, 121, 136, 119, 138, 139
See application file for complete search history.

(56) References Cited

U.S. PATENT DOCUMENTS

| | | | | |
|---|---|---|---|---|
| 3,009,618 | A * | 11/1961 | Lerner | 226/162 |
| 3,602,414 | A * | 8/1971 | Garfinkel | 226/151 |
| 4,588,121 | A * | 5/1986 | Olesen | 227/120 |
| 4,770,334 | A | 9/1988 | Hoshi et al. | |
| 4,978,045 | A | 12/1990 | Murakami et al. | |
| 5,560,529 | A | 10/1996 | Udagawa et al. | |
| 6,039,230 | A * | 3/2000 | Yagi et al. | 227/120 |
| 6,568,579 | B1 * | 5/2003 | Mochizuki | 227/131 |
| 6,616,027 | B1 * | 9/2003 | Mochizuki | 227/131 |
| 6,619,528 | B1 * | 9/2003 | Mochizuki | 227/120 |

* cited by examiner

*Primary Examiner*—Stephen F. Gerrity
*Assistant Examiner*—Paul Durand
(74) *Attorney, Agent, or Firm*—Michael Best & Friedrich LLP

(57) ABSTRACT

A staple storage unit includes return prevention members that prevent a staple positioned for driving from moving back toward the staple storage portion of the staple storage unit. A plurality of staple abutting portions 105*a* and 105*b* are spaced along the draw out direction of the staple band 101 at distances where they do not all abut the staple linking portion 105*d*, thereby increasing the likelihood that at least one of the staple abutting portions will engage the staple linking portion to prevent significant withdrawal of the staple sheet back toward the staple storage portion.

10 Claims, 6 Drawing Sheets

STAPLER CARTRIDGE AND STAPLER APPARATUS COMPRISING THE SAME

BACKGROUND OF THE INVENTION

The present invention relates to a stapler apparatus which binds media (a sheet bundle), such as a plurality of documents printed with a copying machine, a printer, or a composite of machines thereof, etc., with staples, particularly to an improved staple cartridge used in the stapler apparatus.

Such stapler apparatuses conventionally are mounted with a staple cartridge comprising a storage portion for storing rolled sheets of rolled bands of staples that are linked to form a sheet, or stacks of sheets of staples. The staple sheets in the staple cartridge are pulled out, and are drawn sequentially to a staple driving position and the staples are then driven into media for binding.

Staple cartridges mounted to the stapler apparatus are equipped with a return prevention means to abut the staple linking portion of the stable band drawn out with a return stopper pawl so that the staple band pulled out from the storage portion does not return back into the storage portion.

However, the return stopper pawl of the return prevention means abuts the staple linking portion on one location with the paired left and right pawl or to increase the abutting force thereof, a return stopper pawl is disposed in front and back in the direction of staple band pull-out disposed to abut the staple linking portion on two locations with the paired left and right pawl simultaneously.

However, there are situations where the staple linking portion cannot be securely abutted to stop because of variations in the width dimensions of the staples or the gap of the staples that configure the staple band, caused by the adhesive, or the variations in the staple cartridge mounting position, the variations in the gap in the staple linking portion that is abutted by the return stopper pawl from the staple that has been drawn to the driving position, the variation thereof causing the return stopper pawl to ride up on the surface of the staple.

In the state where the return stopper pawl rides up on the surface of the staple, the staple band backs up an amount near the width of the staple, at its maximum to move to be abutted. This results in the staple that had already been drawn to the driving position returning back and causing a discrepancy in its position. This is one of the causes of the binding problems of the mis-driving or biting of staples.

SUMMARY OF THE INVENTION

An objective of the invention, in view of the aforementioned problems, is to provide a staple cartridge that can arrest staple mis-positioning with regard to the driving position within a tolerance range that arrests stapler apparatus binding problems even if there is a variation in the staple gaps caused by staple width dimensions or adhesive or the return stopper pawl riding onto the surface of the staple.

The invention includes a staple cartridge comprising a staple band linking staples in a sheet shape, a storage portion to store the staple band, and a return stopper means that abuts staples at the staple linking portion to prevent staples linked together in a staple band drawn from the staple storage portion from returning to the staple storage portion, the aforementioned return stopper means comprise a plurality of staple abutting portions, the plurality of staple abutting portions are disposed front and back along the direction of the draw out of the staple band and in gaps where they do not abut the aforementioned staple linking portion simultaneously.

According to one aspect of the invention, one of the plurality of abutting portions disposed front and back along the direction of draw out of the staple band increases the probability to abut the staple linking portion. Also, in the worst case, if all of the stopper portions ride up onto the surface of the staples, it is simple to hold that down by setting a number of stopper portions to within a tolerance range without causing mis-positioning corresponding to the surface of the staple as in the past.

According to another aspect of the invention, the plurality of stopper portions of the return prevention means is composed of the quantity of M, and when the width dimension in the direction of staple draw out is set to Lmm, each stopper portion is arranged front and back in the direction of draw out and the gap of the stopper portions positioned front and back is set to L/Mmm.

According to another aspect of this invention, the L/Mmm gap for the plurality of stopper portions for the return prevention means provides an optimum positional relationship.

According to another aspect of the invention, the plurality of stopper portions of the return prevention means is composed of the quantity of M, and when the width dimension in the direction of staple draw out is set to Lmm, each stopper portion is arranged front and back in the direction of draw out and the gap of the stopper portions positioned front and back is set to a value that adds L/Mmm to nL/Mmm (where n is a natural number).

According to another aspect of this invention, the stoppers in a plurality of locations are disposed with the optimum positional relationship, such that each of the stopper portions is arranged to span a plurality of staples.

The invention further provides a staple cartridge comprising a staple band linking staples in a sheet shape, a storage portion to store the staple band, and a return stopper means that abuts staples at the staple linking portion to prevent staples linked together in a staple band drawn from the staple storage portion from returning to the staple storage portion. The aforementioned return stopper means comprise a plurality of staple abutting portions, the plurality of staple abutting portions are disposed front and back along the direction of the draw out of the staple band and in gaps where they do not abut the aforementioned staple linking portion simultaneously.

Below, an embodiment of the stapler apparatus according to the present invention will be described in accordance with the figures.

DESCRIPTION OF THE REFERENCE NUMERALS

Figure 1:
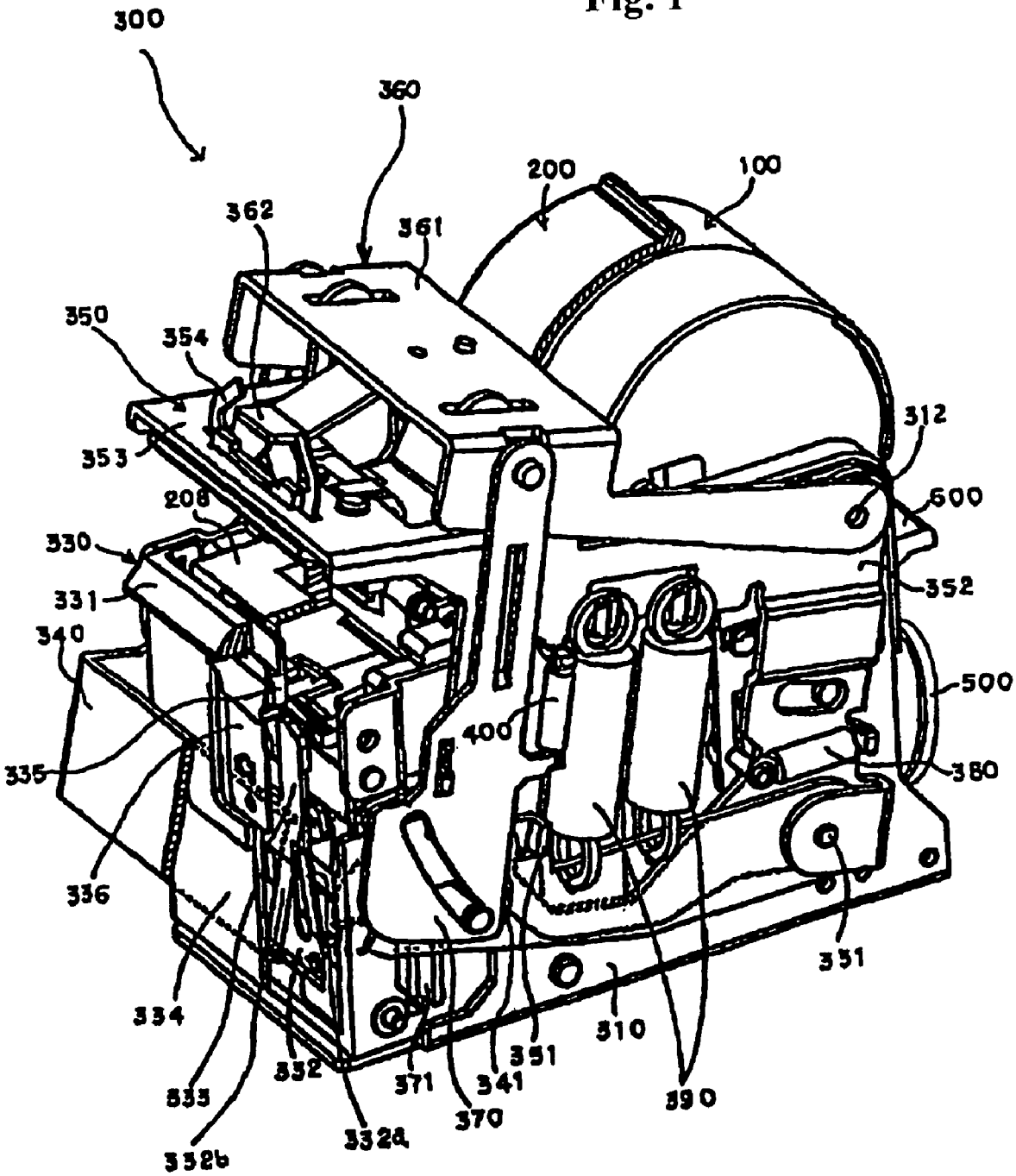
FIG. 1 is a plan view comprising a sectional view of a stapler device mounted with the staple cartridge according to the embodiment of the instant invention.

100 Staple cartridge
101 Staple band material
101*a* Staple adhesive tape
102 Staple storage portion
105 Return stopper pawl member (return prevention means)
105*a* Return stopper pawl (staple abutting portion)
105*b* Return stopper pawl (staple abutting portion)
105*c* Return stopper pawl (staple abutting portion)
105*d* Staple linking portion
200 Cartridge holder
300 Stapler unit

DETAILED DESCRIPTION

FIG. 1 is an external perspective view showing a section of part of the entire stapler apparatus, mainly comprising the staple cartridge 100, the cartridge holder 200 and the stapler unit 300.

Firstly, to describe the apparatus according to the sequence of its assembly, the stapler unit 300 comprises the unit frame 310, the electric drive unit, not shown in the figures, the staple head unit 330, the actuating lever 340, the anvil unit 350, the clincher unit 360, the interlock lever 370, the anvil spring 380, the paper thickness absorbing spring 390, the clincher spring 400 and the manual drive plate 500.

Figure 2:
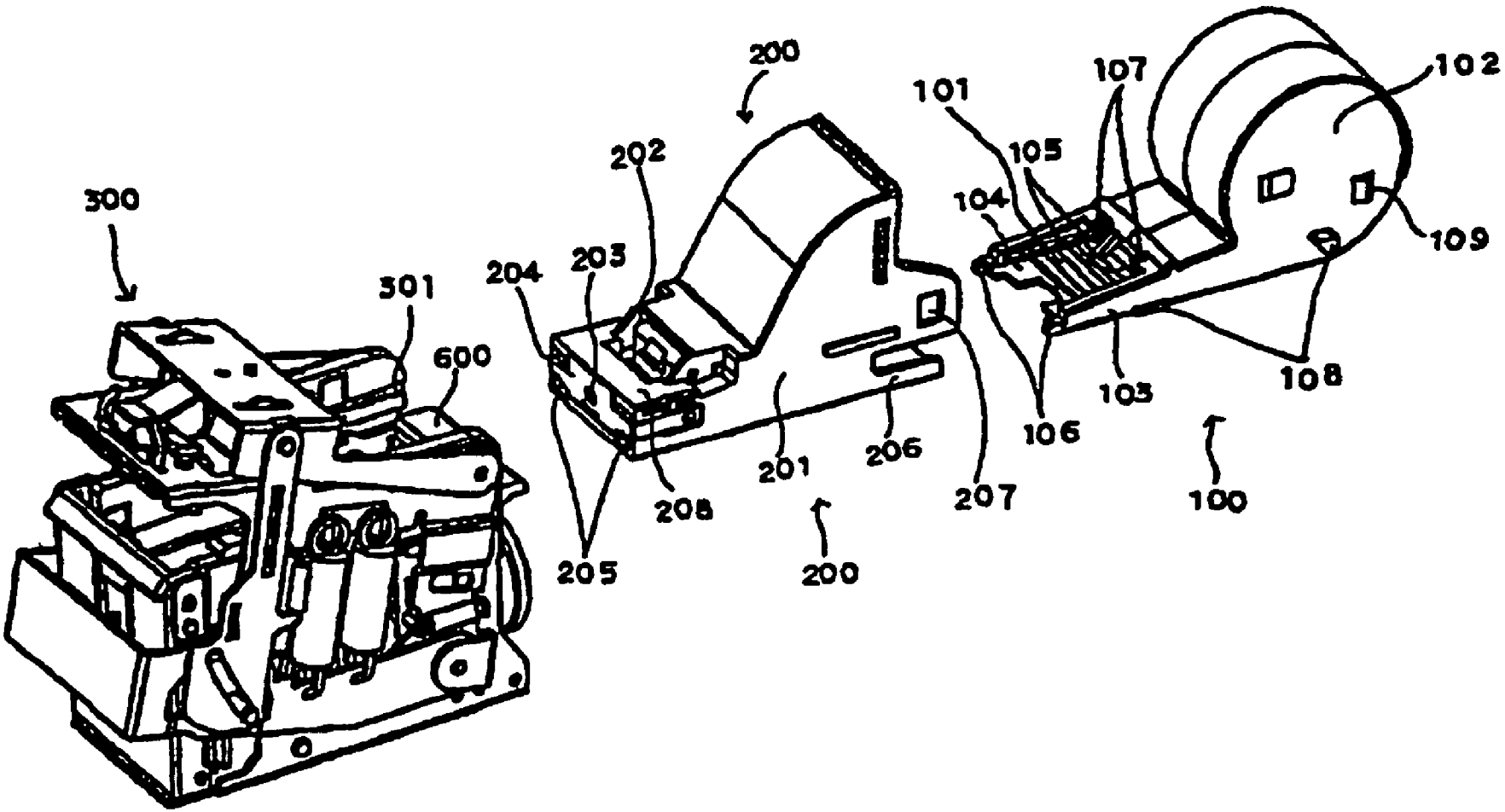
FIG. 2 is a plan view of the disassembled units of the stapler device mounted with the staple cartridge according to the embodiment of the instant invention.

The unit frame 310 is sheet metal formed into a sectional U-shape comprising sides established left, right and a bottom. It internally holds the electric drive unit, thereabove the holder guide 301, which is shown in FIG. 2 and the staple head unit 330 in the leading edge and properly supports other units on the outside side walls thereof.

Note that the electric drive unit, which is not shown in the figures, is composed of a direct current motor that is the stapler drive source, the gear train that decelerates the rotation of the motor to a determined rotating speed and the transmission cams that are decelerated to the determined speed and rotate. Each transmission cam drives the staple head unit 330 and the anvil unit 350 via the actuating lever 340 and the interlock lever 370 and by driving the clincher unit 360 it controls the series of operations of the stapler.

The staple head unit 330 comprises the sheet loading table 331, the driver 332, the former 333, the sheath 334 and the bending block 335.

Furthermore, the staple head unit 330 starts the upward direction displacement of the driver 332 formed with a leaf spring material by the driver drive cam pin disposed on the last level of the electric drive unit.

Displacement of the driver 332 abuts the former abutting piece 332*a* on the driver 332 against the former 333. The driver 332 and former 333 follow a stepped surface, not shown in the figures, formed on the sheath 334 upward to a position where that abutment is released.

The former 333 bends into a U-shape staples drawn to the staple bending position of the bending block bending block 335 and holds to guide U-shaped staples on the sides of the former 333 thereof to enable driving. Note that the position where the staple is bent by the former 333 corresponds to the staple driving position below.

In this state, the driver 332 released from abutting the former 333 by the protrusion, not shown in the figures, formed at the sheath 334 is displaced further upward leaving the former 333 in that position.

By displacing upward, the staple driving unit 332*b* positioned at the leading edge of the driver 332 displaces the bending block 335 to the front from the region of movement of the driver 332 and retracts.

The staple driving unit 332*b* of the driver 332 displaced further upward separates from the adhesive staples that have been bent and are adhering to the next staple by adhesive tape. Formed and separated staples are driven into the binding media.

Next, the actuating lever 340 has arms extending left and right along the side surfaces of the anvil unit 350. While nipping in the unit frame 310, they are supported by the interlocking pivot shaft 331 disposed on the anvil unit 350 sides.

In addition, the paper thickness absorbing springs 390 are stretched between the anvil unit 350 in a central location on the left and right arms of the actuating lever 340. These springs 390 constantly urge in the counterclockwise direction around the interlocking pivot shaft 331 to contact with the stopper 351 formed on the anvil unit 350.

The notch 341 comprising an edge to abut with the anvil drive lever, which is not shown in the figures, driven to displacement by the electric drive unit, is formed on the leading edge of the arm positioned on the other edge of the left and right arms. The anvil drive lever swings it clockwise around the interlocking pivot shaft 331 which is pressed and urged downward.

The anvil unit 350, the anvil rocking pivot 352 on one side thereof rockingly supported on the pivot shaft 312 on the unit frame 310, is constantly rotatingly urged in the clockwise direction by the anvil spring 380 around the pivot shaft 312.

The anvil head 353 on the other side follows the rocking of the actuating lever 340 and rocks counter-clockwise resisting the urging force of the anvil spring 380 to nip and support the binding media at a position that corresponds to the thickness thereof.

Note that after the anvil unit 350 nips and supports the binding media by the paper thickness absorbing springs 390, the actuating lever 340 continues acting alone in resistance to the resilient force of the paper thickness absorbing springs 390 because the anvil unit 350 is locked in that nipping position.

To the anvil head 353 that nips the binding media on the anvil unit 350, the clincher unit 360 that has the left and right paired clinchers 354 for bending the leading edges of staples that have penetrated the binding media driven from below the binding media, is disposed to follow.

The clincher unit 360 comprises the clincher lever 361 and is supported by the pivot shaft 312 on the unit frame 310 which is also the pivot for the anvil rocking pivot 352 on the anvil unit 350. To the leading edge of the clincher unit 360 is mounted the clincher head 362 that bends staples that have been driven and rocks the clincher 354 mounted to the anvil head 353 on the anvil unit 350.

The clincher head 362 is press formed using a steel plate for a spring with a thickness of 1.5 mm while the clincher lever 361 is formed using a plated steel plate of a thickness of 2.0 mm, to absorb the difference in pressing stroke of the clincher 354.

Next, the interlock lever 370 follows the rocking of the anvil unit 350 via the clincher spring 400 to rock the clincher unit 360 and is disposed to continue rotating with the rocking of the clincher drive lever, not shown in the drawings, while the anvil unit 350 nips and stops the binding media. After the anvil unit 350 stops at the nipping position that corresponds to the thickness of the binding media, it continues rotating to bend the staples.

The manual drive plate 500 is for resetting stapling defects by manually operating the stapler when a staple is not properly driven into the binding media and the defective staple prevents the stapler apparatus from operating, and thus causes a stapling problem when driving staples. The drive plate 500 is mated to the rotating shaft extending to the back side of the output shaft of the direct current motor of the electric drive unit, which is not shown, when manual operations are necessary.

FIG. 2 is an exploded perspective view showing the cartridge holder 200 and staple cartridge 100 that are mounted on the stapler unit 300 in FIG. 1 pulled out.

When pulling from the stapler unit 300, first the cartridge lock lever 600 which abuts the staple cartridge 100 and urgingly supports in the mounting direction is manually pressed downward to release the abutting, then the staple cartridge 100 is pulled from the cartridge holder 200.

Then, the cartridge holder 200 is pulled from the stapler unit 300. Conversely, it is also possible to remove the staple cartridge 100 from the cartridge holder 200 after pulling out the cartridge holder 200 while the staple cartridge 100 is mounted to the cartridge holder 200.

Note that the reverse procedures are acceptable when mounting the staple cartridge 100 and cartridge holder 200 to the stapler unit 300.

The staple cartridge 100 is composed of a semi-transparent plastic case and comprises the storage unit 102 that stores the staple band material 101 into which sheets of a plurality of straight staples linked into a band are wrapped into a roll, and the pull-out guide 103 for pulling out the staple band material 101.

The pull-out guide 103 is mounted to the cartridge holder 200 and is equipped with the opening 104 the guide surface on the leading top side being widely cut away to abut the staple feed means 202 on the cartridge holder 200, the back-feed stopper pawl 105 to arrest so that the staple band material 101 pulled out from the storage unit 102 does not return back into the storage unit 102, and the leading edge stopper 106 that restricts the leading edge of the staple band material 101 that has been pulled out and that positions the leading edge thereof at the binding position while mounted to the stapler unit 300.

Also, it comprises the feed pawl advancing protrusion 107 that protrudes into the guide surface on the top-side of the leading edge formed on the opening 104 on the pull-out guide 103 and advances the staple feed means 202 when mounting to the cartridge holder 200 to press the leading edge of staples in the staple band material 101 to the edge stopper 106.

Furthermore, to both sides of the staple cartridge 100 are equipped the guide protrusion 108 guided when mounting to the cartridge holder 200 and the stopper pawl 109 stopped when mounting to the cartridge holder cartridge holder 200.

Though not shown in the figures, it is possible to bend open the bottom portion of the staple cartridge 100 from an appropriate position on the back-feed stopper pawl 105 and the edge stopper 106 to the storage unit 102. By opening, the back-feed stopper pawl 105 is released from stopping the staple band material 101 thereby making it possible to discard all remaining staples when discarding.

The cartridge holder 200 is composed of the holder unit 201, the staple feed means 202, the magnet 203, the guide plate 204 comprising a non-magnetic body, the opening 205, the guide 206, the abutting hole 207 and the auxiliary table 208.

The holder unit 201 is formed of a plastic material to cover the front half of the staple cartridge 100.

The staple feed means 202 is rockingly supported on the holder unit 201 and is constantly urged to the staple pull-out direction by a leaf spring, which is not shown in the figures. It is interlocked to the nipping action of the binding means by the anvil unit 350 and charged. It comprises a feed pawl for pressing the staple sheet surface of the staple band material 101 with the recovery action caused by the release of the charge to advance the staple band material 101.

The magnet 203 and the guide plate 204 faces the staple to be driven at the binding position when mounted to the stapler unit 300 and the magnetic attraction of the magnet attracts mis-driven staples to discharge them outside from the stapler unit 300.

The opening 205 is for setting the leading edge of the stopper 106 on the staple cartridge 100 and the leading edge of the staple to protrude and be set at the binding position The guide 206 is for guiding the guide protrusion 108 on the staple cartridge 100 and is composed of a cut-out groove and a bottom surface.

The abutting hole 207 abuts the stopper pawl 108 on the staple cartridge 100 and it is one of the supplementary stopping means on the staple cartridge 100 until the staple cartridge 100 is locked by the cartridge lock lever 600.

The supplementary table 208 acts as the loading table where the binding media is loaded along with the table 331 on the staple head unit 330, as shown in FIG. 1, when mounted to the stapler unit 300.

Figure 3:
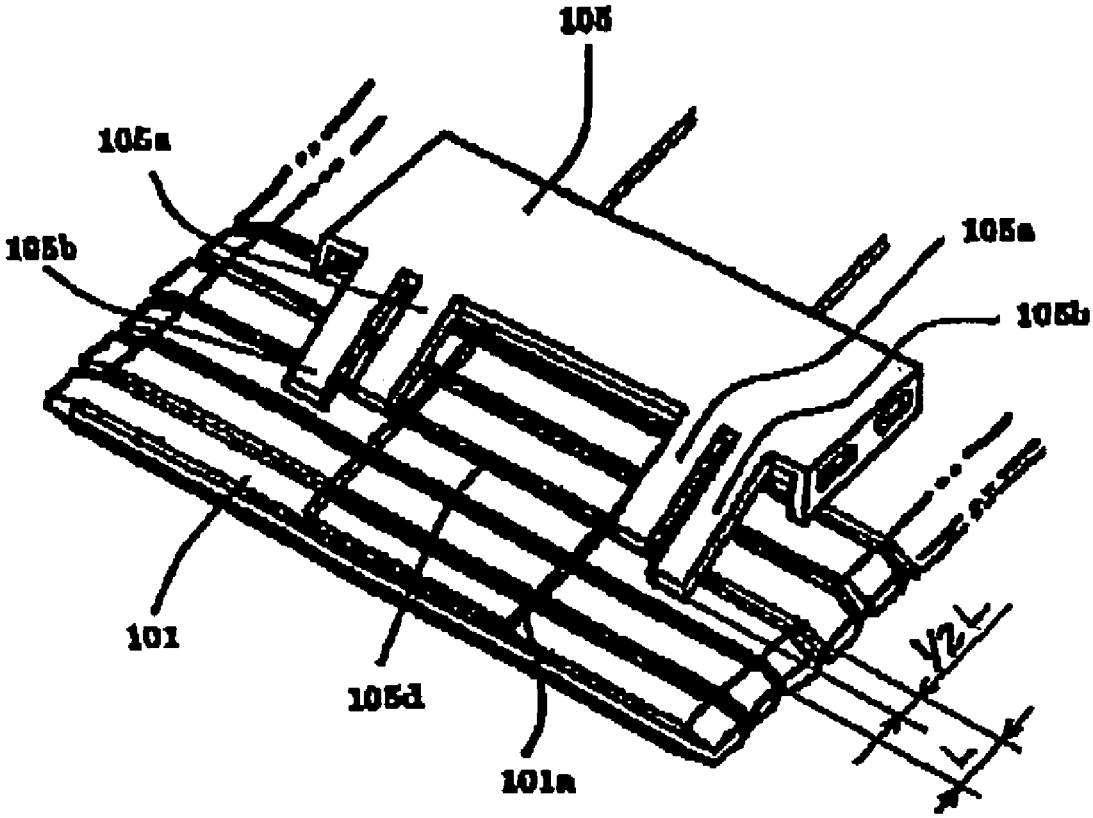
FIG. 3 is an expanded explanatory view depicting the abutting of the staple band by the return stopper pawl in the staple cartridge according to the invention.

FIG. 3 shows the return stopper pawl 105 (the return prevention means) on the staple cartridge 100 abutting the staple linking portion 105*d* on the staple band 101. This return stopper pawl 105 is positioned so that it avoids the adhesive tape 101*a* that glues the staples on the staple band 101 to each other and are arranged symmetrically left and right so that the staple band 101 can be drawn out parallel, and the return stopper pawl portions (staple stopper portions) 105*a* and 105*b* are formed at the positions abutting the staple linking portion 105*d* on the staple band 101 in positions offset along the width of the staple. In this case, at the maximum, the amount offset on the staple band 101 can be held to within the width dimension of the width of the staple on the staple band 101 separated into two parts.

Note that after a 0.2 mm thick plate is press formed to a spring member for the return stopper pawl 105, the return stopper pawl 105*a* and 105*b* are bent to according to the inclination. Also, the amount of discrepancy of the return stopper pawl 105*a* and 105*b* is 0.2 mm to 0.25 mm as a guide for bending, equivalent to approximately half of the width of the staple at 0.4 mm to 0.5 mm. Furthermore, the shape, angle of their bending or the position of their bending for the return stopper pawl 105*a* and 105*b* is changed appropriately according to the staple band 101 so that there is no variation in their abutting performance.

Also, the structure arranges the return stopper pawl 105 to the back side on the staple tape 101*a* and the staple band 101 but because there is no need to avoid the staple tape 101*a*, the return stopper pawl 105 can be arranged in symmetrical positions left and right thereof to allow the parallel pull out of the staple band 101.

Figure 4:
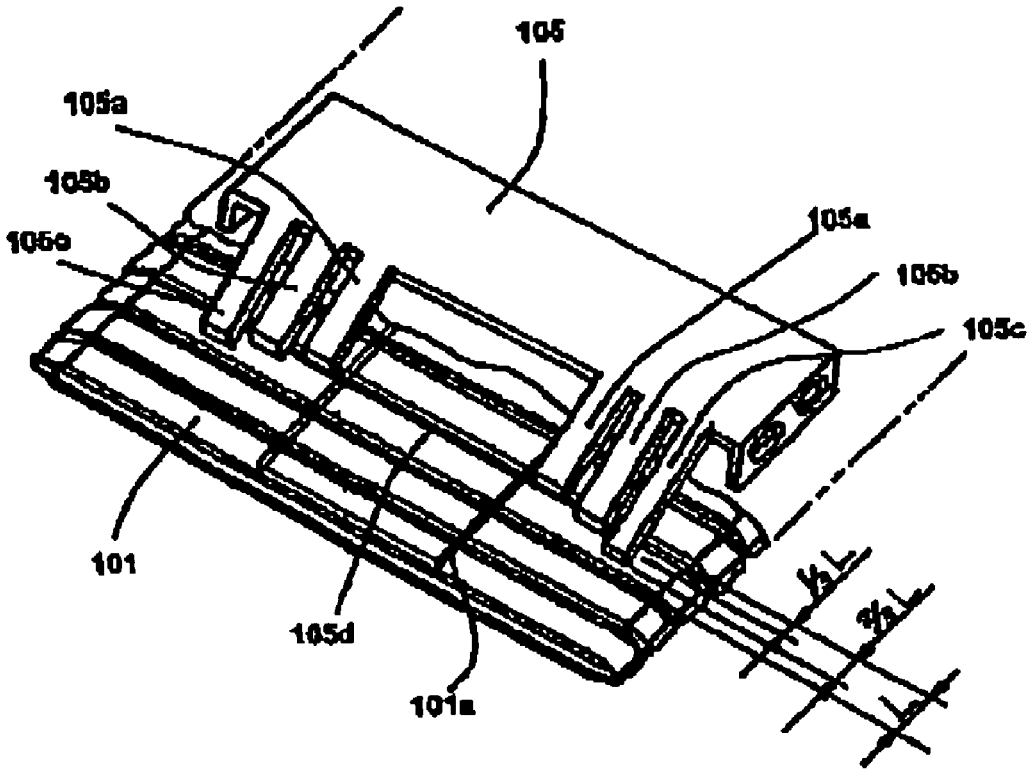
FIG. 4 is an expanded explanatory view depicting the abutting of the staple band by the return stopper pawl in the staple cartridge of another embodiment of the invention.
Figure 5:
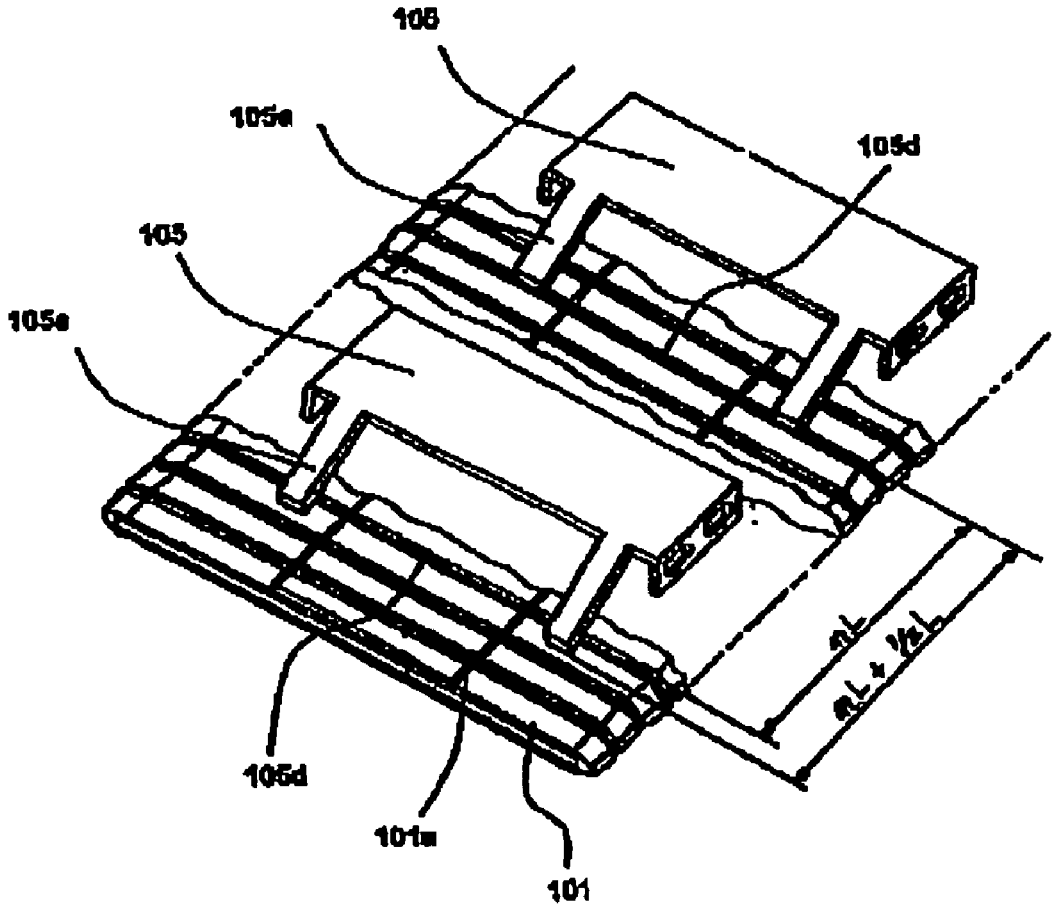
FIG. 5 is an expanded explanatory view depicting the abutting of the staple band by the return stopper pawl in the staple cartridge according to another embodiment of the invention.

FIG. 4 and FIG. 5 show another embodiment of an abutting method of the return stopper pawl for the staple band 101 on the staple cartridge 100.

FIG. 4 shows the 3 portions of the return stopper pawl portions (staple abutting portions) 105*a*, 105*b* and 105*c* on the return stopper pawl 105 (return prevention means) arranged front and back in the direction of staple band 101 draw out and abutting the staple linking portion 105*d* on the staple band 101. Each of these are formed to have three equal gaps in the width of the staple. In this case, it is possible to arrest the amount of offset of the staple band 101 within three equal parts of the staple band 101 width in the width dimension.

Note that the aforementioned embodiment shows two return stopper portions of 105*a* and 105*b* and three portions of 105*a*, 105*b* and 105*c*. However, generally, with the return stopper pawl portion of M and the width dimension in the direction of drawing out the staple set to Lmm, it is acceptable to arrange each of the stopper pawls front and back in the direction of staple draw-out with the gap of L/Mmm.

Also, it is acceptable to set the appropriate gaps if it is not possible to form stopper pawl portions in equal gaps on opposite surfaces of staples that have enough space. In such case, the amount of offset of the staple band 101 is dependent upon the maximum gap.

FIG. 5 shows return stopper pawl (return prevention means) 105, the return stopper pawl portion (staple abutting portion) composed of the single pawl 105*a* arranged front and back in the direction of draw out of the staple band 101 and abutting the staple linking portion 105*d* on the staple band 101, being arranged in a position adding half of the staple width to the n part of the staple width. In this case, the amount of offset of the staple band 101 is half of the width of the staple band 101, if there is no difference in the dimension of the staple width.

Note that the gap of the plurality of return stopper pawl portions on the return stopper pawl 105 can be arranged in different gap positions that are not n portions of the staple width. In such case, the amount of offset of the staple band 101 is maximum width of the gap of the plurality of return stopper pawl portions. Also, n is a natural number including 0.

Figure 6:
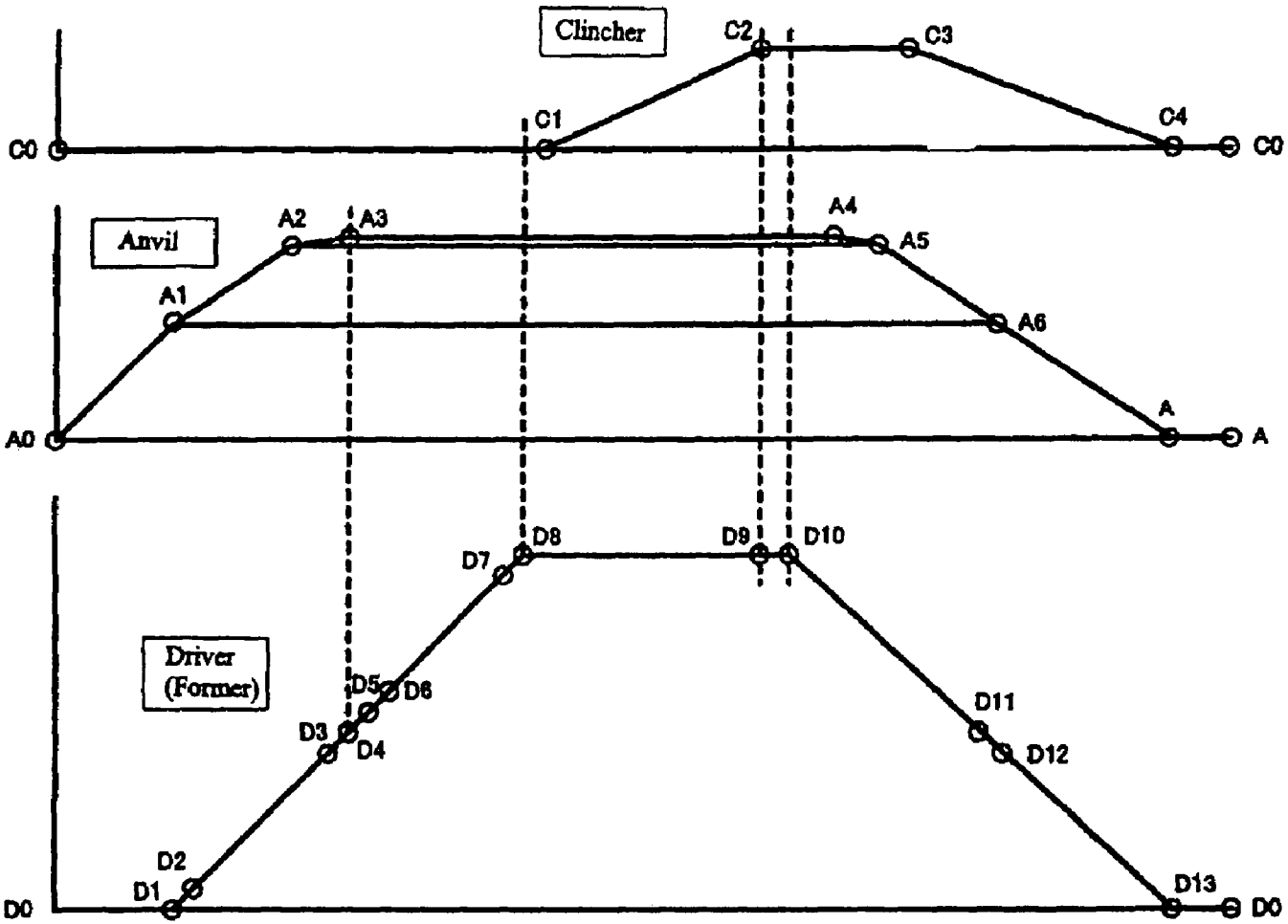
FIG. 6 is a timing chart of the operations of the stapler apparatus according to the embodiment of the instant invention.

FIG. 6 is a timing chart to illustrate the operation of each of the driver, former, anvil and clincher units' processes. The horizontal axis indicates the angle of rotation of the drive cam that drives each unit and the vertical axis shows the amount of displacement of the levers for each unit. The following generally describes the series of actions according to FIG. 1.

Initially, along with the setting to the stapling position of the binding media a staple execution instruction signal is output to the stapler apparatus from an outside source.

The instruction signal starts the rotation of the direct current motor in the electric drive unit, which is not shown in the drawings, first pushing the actuating lever 340 in the downward direction by the anvil drive cam, which is not shown in the drawings, resisting the anvil spring 380.

Following the displacement of the actuating lever 340, the anvil unit 350 moves downward to start nipping the binding media.

Note that, interlocked to the nipping of the anvil unit 350, the clincher unit 360 interlocked by the interlock lever 370 and the clincher spring 400 follows the anvil unit 350.

In describing the operation of the anvil unit 360, beginning from the idling position A0, rocking stops at a nipped position according to the thickness (the number of sheets) of the binding media set at the binding position, between the position A1 where, for example, 100 pages of binding media are nipped to the position A2 where 0 pages are nipped of binding media.

After nipping the binding media by the anvil unit 360, only the actuating lever 340 continues displacement resisting the paper thickness absorbing springs 390. The anvil unit 360 maintains a displaced state to the position equivalent to the position A3 by applying an over-stroke to the position A2 to enable the secure nipping even if there are 0 pages of binding media, in consideration of variations in parts and their assembly, to complete the nipping operation of the binding media using the anvil unit 360.

Before operating to the position A3 to complete the nipping operation of the binding media using the anvil unit 360, the driver drive cam CA40, shown in FIG. 4 displaces the driver 332, which is not shown in the drawing, upward, and the former 333 following this displacement is pressed upward.

The driver 332 begins moving from the position D1 when the clincher unit 360 is beyond the position A1, at position D2, the former 333 presses the staple drawing to the driving position and starts forming the staple into a U-shape. In the continuing stroke, by pushing both leading edges of bent staples formed into that shape against the sides of the bending block 335 to guide it, both leading edges of the staple are secured front, back left and right by the non-magnetic materials of the guide plate 204 walls composed of the former 333, the bending block 335 and the cartridge holder 200.

Then, the leading edges that touch the formed staple of the driver 332 are pressed into the oblique surfaces of the bending block 335. The leading edge portion of the driver 332 touches the formed staple at the position D3 with the bending block 335 retracted from the area of movement of the leading edge of the driver 332. The leading edge of the formed staple pressed by the driver 332 delayed from the position A3 where the anvil 350 nips the binding media reaches the position D4 that touches the surface of the sheet of the binding media to start driving the formed staple into the binding media by the driver 332.

After the driver 332 starts driving the staple, at the same time that the abutting portion that was abutting the former 333 on the driver 332 is released from abutting, by the level protrusion on the sheath 334 at the slightly delayed position D5, the former 333 is released from abutting with the driver 332 at the position D6 just prior to the leading edge of the former 333 touching the surface of the sheets in the binding media and the former 333 stops and the former guides the bend staple driven by the driver 332.

Continuing on, the formed staple is driven by the driver 332, and after the formed staple crown touches the surface of the sheets in the binding media at the position D7, the driver 332 is further driven by the driver drive cam at the position D8, but because the driver 332 cannot press the formed staples in, the driver 332 comprising a leaf spring, itself is elastically deformed the amount of the over-stroke to absorb the difference of the mounting position to securely drive the formed staple.

The clincher unit 360 is rocked by the clincher drive unit 602 pressed downward by the clincher drive cam CA10 shown in FIG. 11 from position C1 immediately after the position D8 where the formed staple is driven by the driver 332, pressing the clincher 354 to complete the clinching operation at the position C2 by bending the leading edges of the staples that have penetrated the binding media.

After the clinching operation is completed, first, the recovery operation is started for the driver 332 at the position D11. The former 333 part way is re-interlocked and returned to the position D0 which is equivalent to the initial position passing through the positions of D12 and D13.

The anvil unit 350 recovery operation is started slightly delayed to the recovery operation of the driver 332 and is returned to the position A7 which is equivalent to the initial position passing through the position A6.

Finally, the anvil unit 360 recovery operation is started slightly delayed to the recovery operation of the driver 350 and is returned to the position C4 which is equivalent to the initial position to complete the series of the staple operation.

The invention claimed is:

1. A staple storage device comprising:

a staple storage portion;

a band of staples in the staple storage portion, the band of staples linking individual staples together at respective staple linking portions; and a return prevention device operable to substantially prevent the band of staples from returning toward the staple storage portion, the return prevention device including a plurality of staple abutting portions spaced apart along a staple feed direction of the band of staples and substantially continuously engaging the band of staples as the band moves in the staple feed direction;

wherein each individual staple has a staple width in the staple feed direction; and wherein the plurality of staple abutting portions are spaced apart at a distance that is not a natural number multiple of the staple width;

wherein there are M staple abutting portions and wherein an individual staple has a width L along the staple feed direction, the plurality of staple abutting portions being spaced apart such that successive staple abutting portions are spaced by a distance of L/M.

2. The staple storage device of claim 1, wherein the return prevention device includes a body portion and the plurality of staple abutting portions extend from the body portion.

3. The staple storage device of claim 2, wherein the return prevention device includes a second plurality of staple abutting portions extending from the body portion and spaced from the first plurality of staple abutting portions in a direction normal to the staple feed direction.

4. The staple storage device of claim 1, wherein the staple storage portion is part of a cartridge for storing a rolled band of staples.

5. A staple storage device comprising:

a staple storage portion;

a band of staples in the staple storage portion, the band of staples linking individual staples together at respective staple linking portions; and a return prevention device operable to substantially prevent the band of staples from returning toward the staple storage portion, the return prevention device including a plurality of staple abutting portions spaced apart along a staple feed direction of the band of staples and substantially continuously engaging the band of staples as the band moves in the staple feed direction;

wherein each individual staple has a staple width in the staple feed direction; and wherein the plurality of staple abutting portions are spaced apart at a distance that is not a natural number multiple of the staple width;

wherein there are M staple abutting portions and wherein an individual staple has a width L along the staple feed direction, the plurality of staple abutting portions being spaced apart such that successive staple abutting portions are spaced by a distance of n*L+L/M, where n is a natural number.

6. The staple storage device of claim 5, wherein the return prevention device includes a body portion and the plurality of staple abutting portions extend from the body portion.

7. The staple storage device of claim 6, wherein the return prevention device includes a second plurality of staple abutting portions extending from the body portion and spaced from the first plurality of staple abutting portions in a direction normal to the staple feed direction.

8. The staple storage device of claim 5, wherein the return prevention device includes multiple spaced apart body portions and one of the plurality of staple abutting portions extends from each of the multiple body portions.

9. The staple storage device of claim 8, wherein the return prevention device includes a second plurality of staple abutting portions, one of the second plurality of staple abutting portions extending from each of the multiple body portions and spaced from the first plurality of staple abutting portions in a direction normal to the staple feed direction.

10. The staple storage device of claim 5, wherein the staple storage portion is part of a cartridge for storing a rolled band of staples.

* * * * *